US006099053A

United States Patent [19]

Huang

[11] Patent Number: 6,099,053

[45] Date of Patent: Aug. 8, 2000

[54] LOCK WITH IMPROVED TORSIONAL STRENGTH

[75] Inventor: Lan-Shi Huang, Kaohsiung, Taiwan

[73] Assignee: Taiwan Fu Hsing Industrial Co., Ltd., Taiwan

[21] Appl. No.: 09/209,432

[22] Filed: Dec. 11, 1998

[51] Int. Cl.[7] ..... E02B 3/00

[52] U.S. Cl. ..... 292/336.3

[58] Field of Search ..... 292/336.3, 336.5, 292/165, 167, DIG. 52, 357, 358, 359, 347, DIG. 30; 70/467, 468, 471, 477, 478, 479, 484, 485, 224, 215, 216, DIG. 31

[56] References Cited

U.S. PATENT DOCUMENTS

| | | | |
|---|---|---|---|
| 2,795,948 | 6/1957 | Rayburn | 292/357 |
| 2,998,274 | 8/1961 | Russell | 70/467 |
| 5,074,607 | 12/1991 | Lin | 292/359 |
| 5,118,152 | 6/1992 | Lin | 292/356 |
| 5,177,987 | 1/1993 | Shen | 70/224 |
| 5,284,372 | 2/1994 | Lin | 292/336.3 |
| 5,301,526 | 4/1994 | Fann et al. | 70/224 |
| 5,322,333 | 6/1994 | Norton, II et al. | 292/336.3 |

*Primary Examiner*—B. Dayoan
*Assistant Examiner*—John B. Walsh
*Attorney, Agent, or Firm*—Watson Cole Grindle Watson

[57] ABSTRACT

A lock includes an inner handle, an outer handle, and a latch controlled by either handle. A spindle has an end connected to the outer handle. The spindle includes a protrusion engaged with a slit of the outer handle. An outside rose and a catch plate are mounted around the spindle. The catch plate includes a hole with a recessed section for releasably engaging with a tongue plate. A retractor has increased thickness and is engaged with the other end of the spindle.

2 Claims, 7 Drawing Sheets

LOCK WITH IMPROVED TORSIONAL STRENGTH

BACKGROUND OF THE INVENTION

1. Field of the Invention

The present invention relates to a lock with improved torsional strength, and more particularly to a cylindrical tubular lock having an outer handle.

2. Description of the Related Art

U.S. Pat. No. 4,966,399 issued to Lin on Oct. 30, 1990 discloses a cylindrical lock comprising an outside knob 2 that includes a replacing plate 26 attached to an end of the knob 2, a square shaft 25 extended through the replacing plate 26, and an outside grip 21 engaged with a shaft hole 222 of an outside knob cap 22. Two placing notches 223 are symmetrically set at upper and lower edges of the shaft hole 22 for retaining two limit plates 28 in place. The limit plate 28 includes an L-shaped slot 281 through which a moving rod 29 extends. An end of the moving rod 29 is engaged with a lock core in the outside grip 21, and the other end of the moving rod 29 is engaged with a turning button 11 in the inside grip 12. The replacing plate 26 includes two curved slots 261 for engaging with the moving petal 212 of the outside grip 21.

It is, however, found that an unauthorized person may apply a relatively large torsional force to the outside grip to deform or bend the lockset and thus breaks the lockset. More specifically, the torsional strength of such a lock set is not enough. The present invention is intended to provide an improved design to solve this problem.

SUMMARY OF THE INVENTION

It is a primary object of the present invention to provide a lock having improved torsional strength to prevent intentional forcible breakage.

A lock in accordance with the present invention comprises an inner handle assembly having an inner handle and a locking bar, an outer handle assembly having an outer handle with a slit, and a latch operable by the inner handle and the outer handle. The outer handle assembly further includes:

- a spindle including a first end secured to the outer handle to rotate therewith and a second end, the spindle including a slot defined in a periphery thereof and a protrusion securely engaged with the slit of the outer handle,
- an outside rose mounted around the spindle and including two mounting posts, the spindle being rotatably extended through the outside rose,
- a catch plate including a hole so as to be mounted around the spindle, the hole of the catch plate including a recessed section, the catch plate further including two positioning holes through which the mounting posts of the outside rose are extended to secure the catch plate in place, and
- a retractor securely mounted to the second end of the spindle and including a returning member mounted thereto, the retractor having increased thickness and further including a non-circular hole through which the locking bar is extended.

By such an arrangement, when the lock is in a locked status, the tongue plate is engaged with the recessed section of the catch plate, and when the lock is in an unlocked status, the tongue plate is disengaged from the recessed section of the catch plate.

The retractor further includes a notch for engaging with the tongue plate when the lock is in the locked status.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
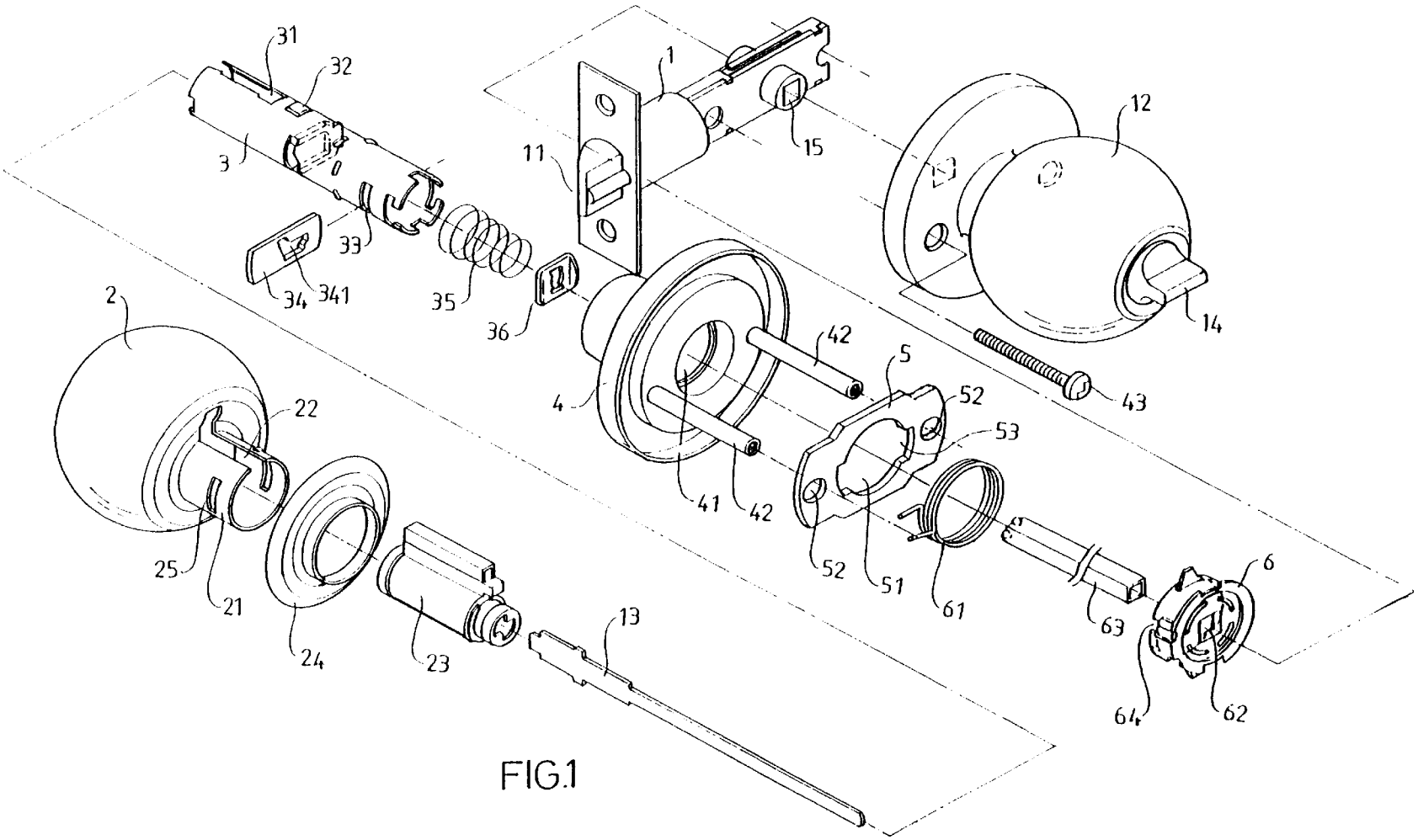
FIG. 1 is an exploded perspective view of a lock in accordance with the present invention.
Figure 2:
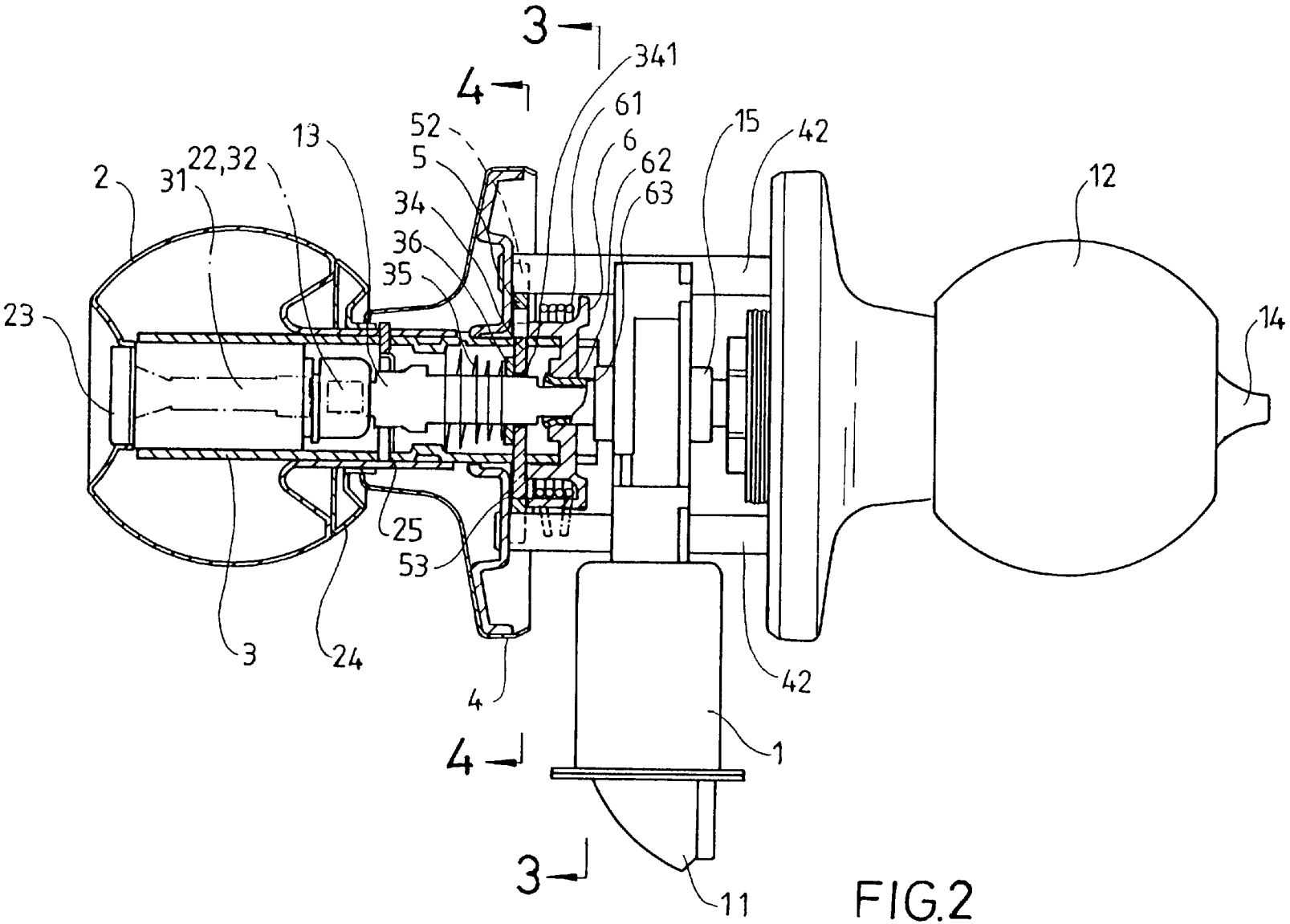
FIG. 2 is a side view, partially sectioned, of the lock in accordance with the present invention, in which the lock is in a locked status.

Referring to FIGS. 1 and 2, a lock in accordance with the present invention generally includes a latch assembly 1 mounted to a door (not shown), an inner handle assembly, and an outer handle assembly. The latch assembly 1 includes a latch 11 and a driving wheel 15 that can be rotated to move the latch 11 from an extended position to a retracted position. A thumbturn 14 is rotatably mounted in the inner handle 12 of the inner handle assembly for driving a tail piece 13 so as to make the lock in a locked status.

The outer handle assembly includes an outer handle 2 that may be of any shape, e.g., a lever or a knob shown in FIG. 1. The outer handle 2 includes a tube or an axial hole of an appropriate length. In this embodiment, the outer handle 2 includes neck tube 21 having a slit 22 for engaging with a lock core 23. An end cover 24 is provided to cover the neck tube 21. A spindle 3 includes a first end engaged with the neck tube 21 to rotate therewith. The spindle 3 includes a cutout 31 for engaging with the lock core 23 and a protrusion 32 for engaging with the slit 22 of the neck tube 21. Thus, in addition to the lock core 23 that is extended through the slit 22 of the neck tube 21 and the cutout 31 of the spindle 3, the protrusion 32 of the spindle 3 is engaged with the slit 22 of the neck tube 21 to provide improved engaging strength.

The spindle 3 is extended through an axial hole 41 of an outside rose 4, and a catch plate 5 and a retractor 6 are mounted to the spindle 3. The spindle 3 includes a slot 33 defined in a periphery thereof through which a tongue plate 34 is movable. The spindle 3 may have two slots 33, while two tongue plates 34 can be used. The tongue plate 34 includes a hole 341 through which the tail piece 13 is extended to control lateral movement of the tongue plate 34 relative to the slot 33, which will be described later. An elastic member 35 is mounted around the spindle 3, and an end plate 36 is provided to prevent disengagement of the elastic member 35.

The outside rose 4 is mounted to an outer side of the door and includes two mounting posts 42 extended through the door and connected to an inside rose (not labeled), and fasteners 43 are provided to secure the outside rose 4 in place. The spindle 3 is rotatably extended through the axial hole 41 of the outside rose 4.

The catch plate 5 includes a hole 51 so as to be mounted around the spindle 3 and in close contact with the outside rose 4. Two positioning holes 52 are provided to both sides of the hole 51 and through which the mounting posts 42 are extended such that the catch plate 5 is not rotatable. The hole 51 of the catch plate 5 includes two ends each having a recessed section 53 for releasable engagement with an end of the tongue plate 34, which will be described later.

The retractor 6 is mounted to the other end of the spindle 3 and has an appropriate increased thickness for mounting a returning member comprising spring 61. The retractor 6 includes a non-circular hole 62 defined in a center thereof through which a locking bar 63 is extended. The locking bar 63 is extended through the driving wheel 15 and an inner spindle (not shown) such that rotation of the inner handle 12 or the outer handle 2 causes the driving wheel 15 to turn and thus moves the latch 11 from its extended position to its retracted position. When the rotational force is released, the retractor 6 returns the locking bar 63 to its initial position. The retractor 6 further includes a notch 64 into which the tongue plate 34 is extendible.

Figure 5:
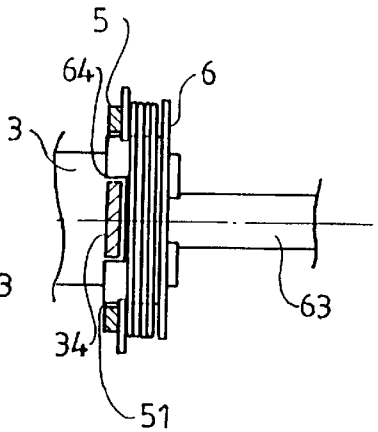
FIG. 5 is a partial sectional view of a spindle and a retractor of the lock in accordance with the present invention.
Figure 4:
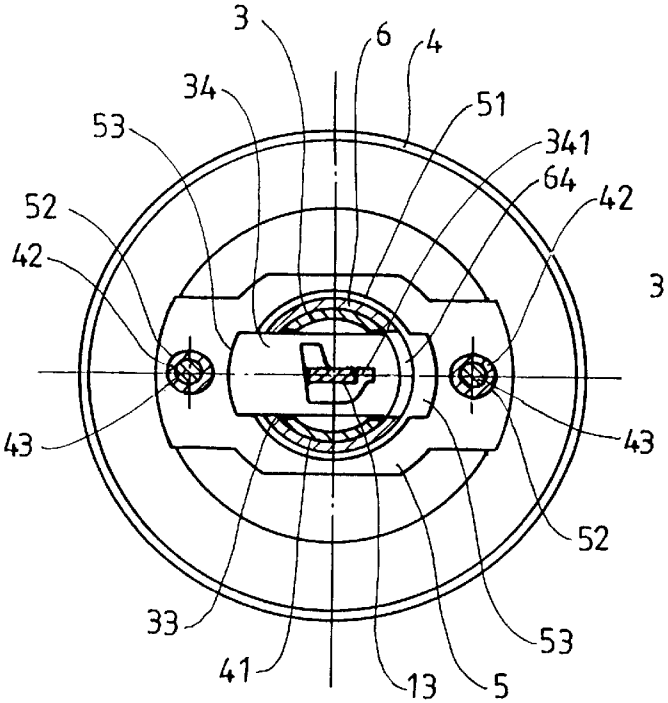
FIG. 4 is a sectional view taken along line 4—4 in FIG. 2.
Figure 3:
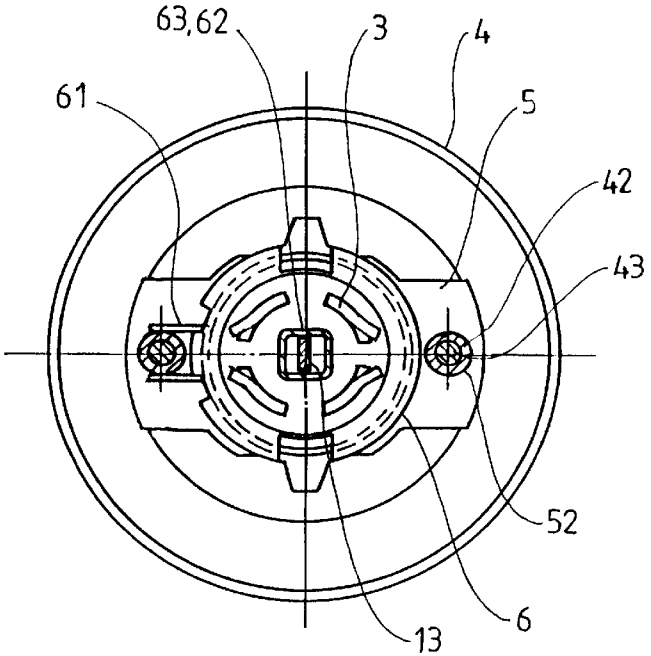
FIG. 3 is a sectional view taken along line 3—3 in FIG. 2.

Referring to FIGS. 2 to 4, when in a locked status, the tongue plate 34 is extended outwards via the slot 33 and is retained in one of the recessed sections 53 of the catch plate 5 (see FIGS. 4 and 5) and the notch 64 of the retractor. Thus, rotational movement of either handle 12, 22 cannot drive the locking bar 63 and the spindle 3, and the latch 11 cannot be retracted.

Figure 6:
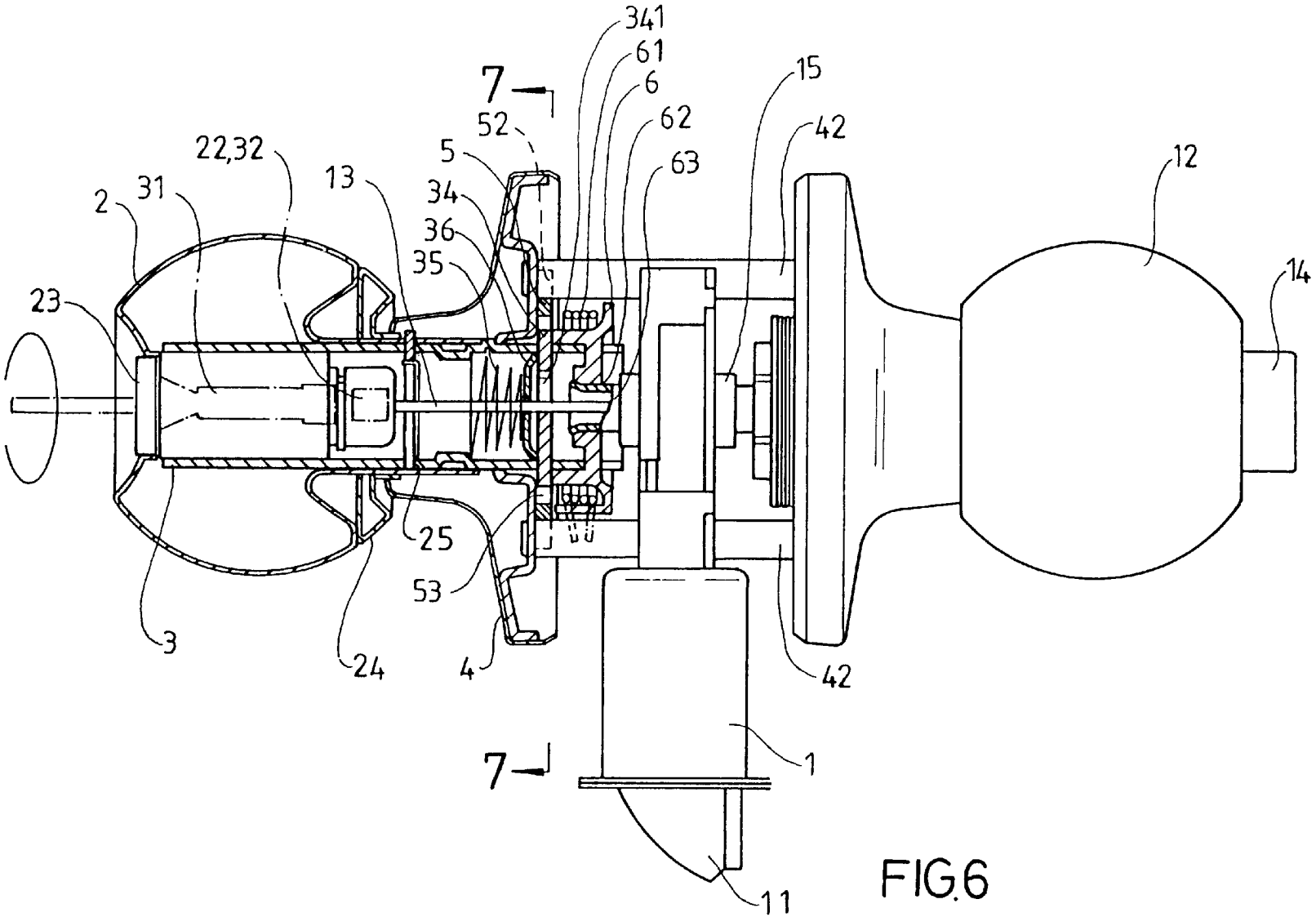
FIG. 6 is a view similar to FIG. 2, in which the lock is unlocked by a key.
Figure 7:
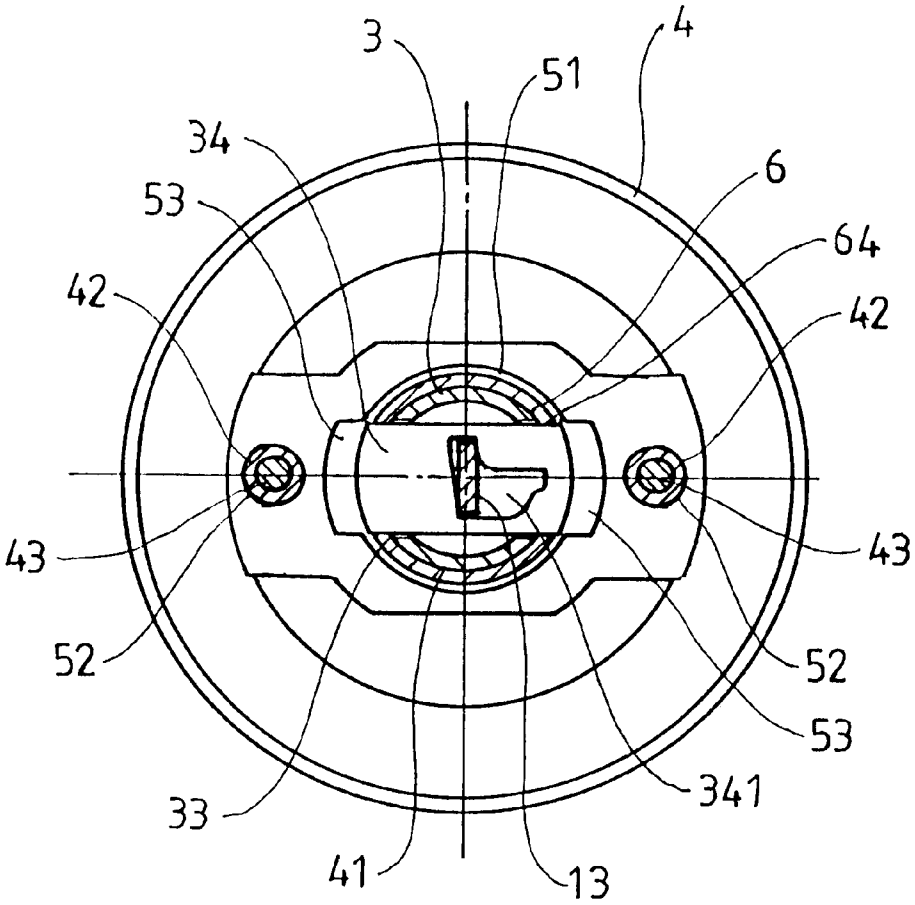
FIG. 7 is a sectional view taken along line 7—7 in FIG. 6.

Referring to FIG. 6, when a proper key is inserted into the lock core 23 and the lock core 23 is rotated through a pre-determined angle, or the thumbturn 14 on the inner handle 12 is rotated, the tailpiece 13 is activated and thus moves the tongue plate 34. Thus, the tongue plate 34 is moved inwards to a position disengaged from the recessed section 53 of the catch plate 5, as shown in FIG. 7. Accordingly, the lock is in an unlocked status.

Figure 8:
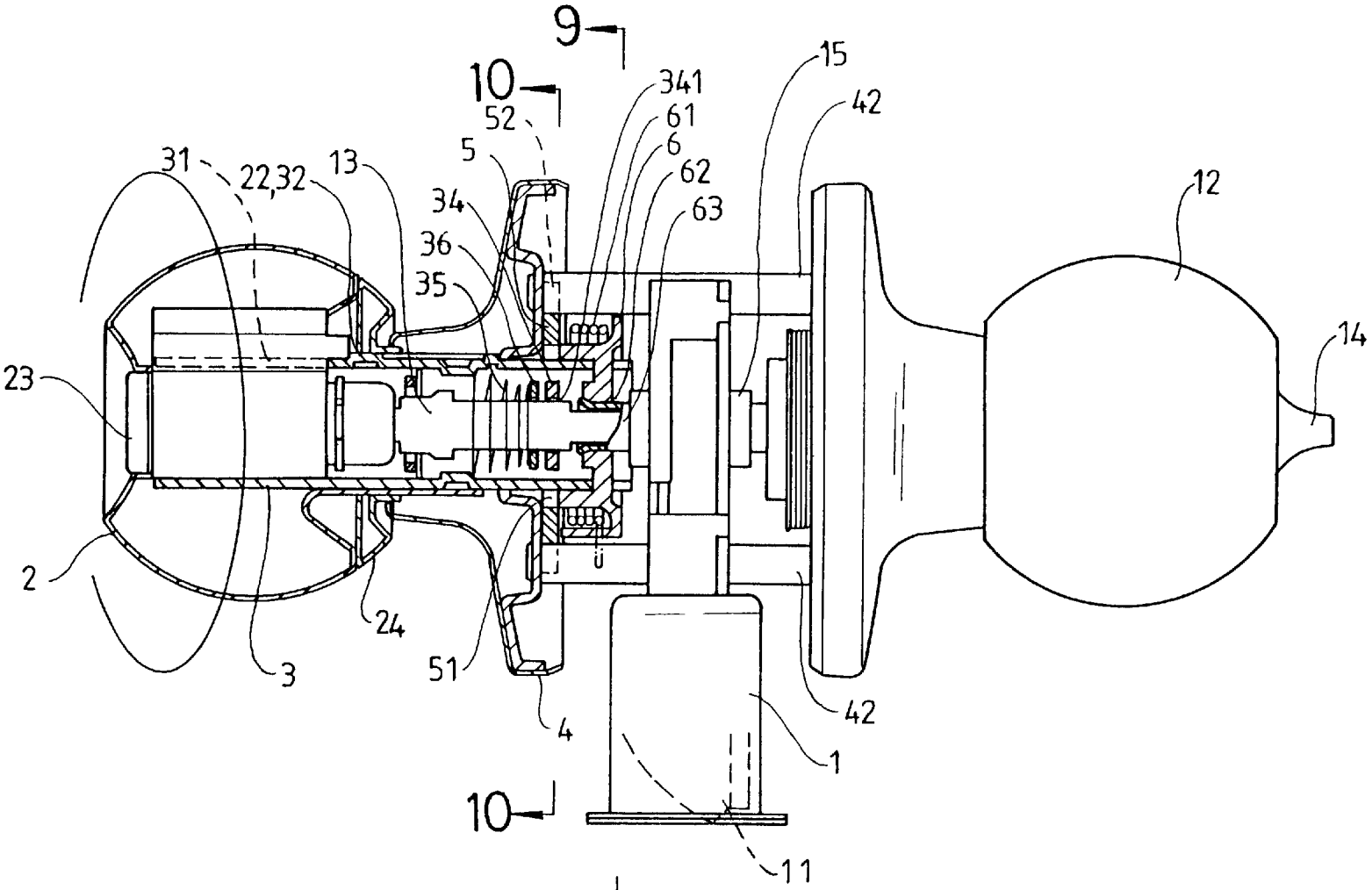
FIG. 8 is a view similar to FIG. 2, in which the lock is in an unlocked status and rotated by either handle.
Figure 10:
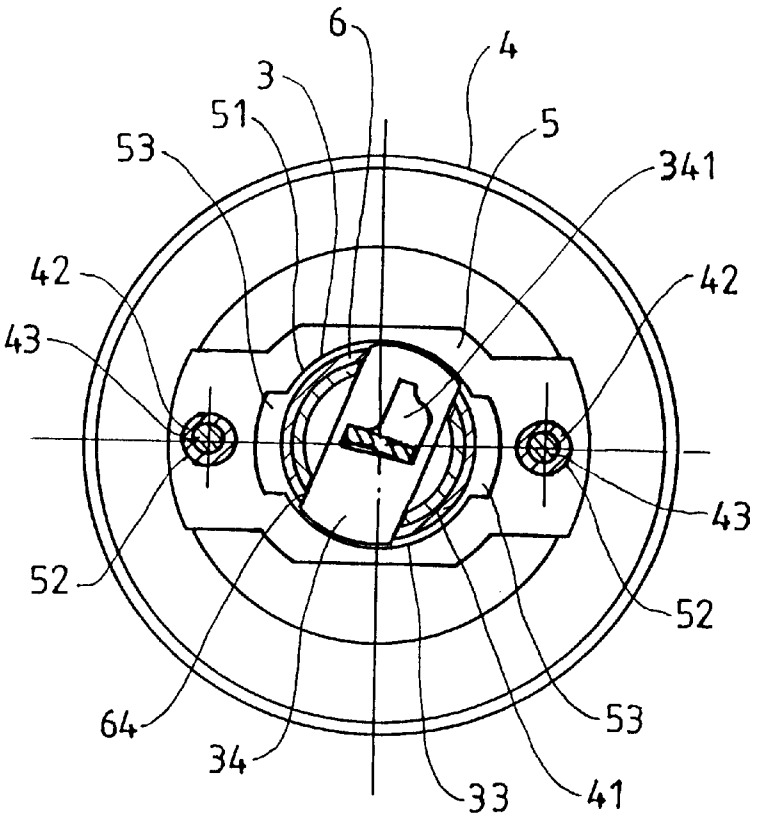
FIG. 10 is a sectional view taken along line 10—10 in FIG. 8.
Figure 9:
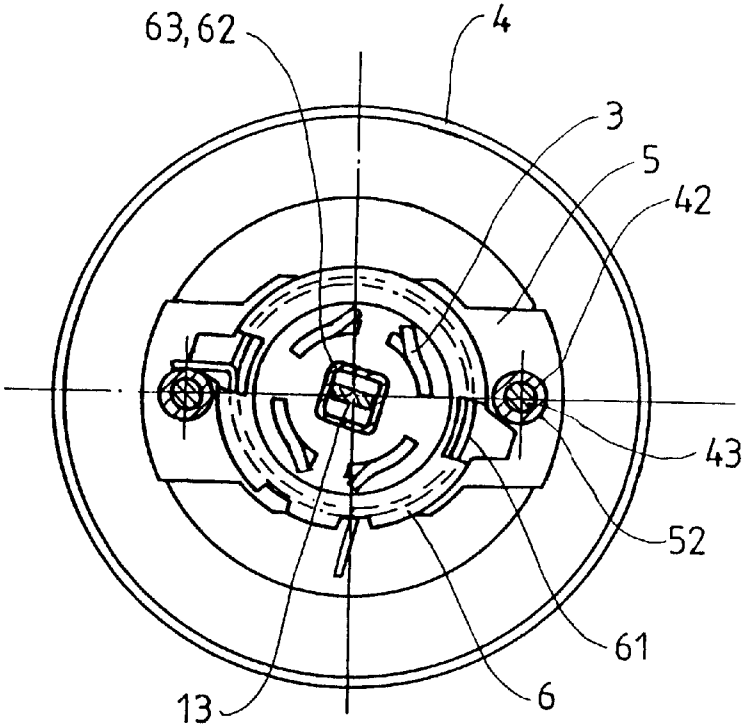
FIG. 9 is a sectional view taken along line 9—9 in FIG. 8.

Referring to FIG. 8, when the tongue plate 34 is disengaged from the recessed section 53 of the catch plate 5, either handle 12, 2 can be rotated. The driving wheel 15 can be rotated by the locking bar 63 in case that the inner handle 12 is rotated. When the outer handle 2 is rotated, the spindle 3 and the retractor 6 are rotated. The retractor 6 turns the locking bar 63 to cause the latch 11 to retract. The tongue plate 34 is rotatable in the hole 51 of the catch plate 5 during rotation of the spindle 3.

According to the above description, it is appreciated that, by means of increasing the thickness of an annular flange of the retractor 6 mounted around the spindle 3 for holding the entire of the second end of the spindle 3 so as to intensify the entire structure of the lock after the lock is assembled, the spindle 3 and the retractor 6 shall not be torn away even if the spindle 3 is subjected to a forcible torsional force. In addition, the notch 64 of the retractor 6 may retain the tongue plate 34 in place when the lock is in a locked status. Furthermore, the tongue plate 34 may share a portion of the forcible torsional force acted on the spindle 3 to prevent damage to the spindle 3 and the retractor 6. The recessed section 53 of the catch plate 5 may be engaged with the tongue plate 34 to prevent disengagement of the tongue plate 34 from the catch plate 5 under the forcible torsional force. Further, the protrusion 32 of the spindle 3 engaged in the slit 22 of the neck tube 21 of the outer handle 2 provides improved structural strength to prevent from disengagement or breakage between the outer handle 2 and the spindle 3 even if the outer handle 2 is subjected to a forcible torsional force. Accordingly, the lock of the present invention provides increased safety and lowers the possibility of illegal break.

Although the invention has been explained in relation to its preferred embodiment, it is to be understood that many other possible modifications and variations can be made without departing from the spirit and scope of the invention as hereinafter claimed.

What is claimed is:

1. A lock comprising an inner handle assembly having an inner handle and a locking bar, an outer handle assembly having an outer handle with a slit, and a latch operable by the inner handle and the outer handle, the outer handle assembly further including:

a spindle including a first end secured to the outer handle to rotate therewith and a second end, a protrusion securely engaged with the slit of the outer handle, the spindle further including a slot defined in a periphery thereof through which a tongue plate is movable, the tongue plate including a hole through which a tail piece being extended to control lateral movement of the tongue plate relative to the slot, an outside rose mounted around the spindle and including two mounting posts, the spindle being rotatably extended through the outside rose, a catch plate including a hole so as to be mounted around the spindle, the hole of the catch plate including a recessed section, the catch plate further including two positioning holes through which the mounting posts of the outside rose are extended to secure the catch plate in place, and a retractor securely mounted to the second end of the spindle and including a returning member mounted thereto, the retractor having an annular flange with increased thickness for holding the entire end of the spindle and further including a non circular hole through which the locking bar is extended.

2. The lock as claimed in claim 1, wherein the retractor further includes a notch for engaging with the tongue plate when the lock is in the locked status.

* * * * *